US006267572B1

(12) United States Patent
Suefuji et al.

(10) Patent No.: US 6,267,572 B1
(45) Date of Patent: Jul. 31, 2001

(54) SCROLL FLUID MACHINE HAVING SCROLL MEMBERS AT EACH END OF A ROTATING HOLLOW SHAFT

(75) Inventors: Kazutaka Suefuji, Shizuoka-ken; Mineo Takahashi, Chiba-ken; Taisuke Torigoe, Osaka, all of (JP)

(73) Assignee: Tokico Ltd., Kawasaki (JP)

( * ) Notice: Subject to any disclaimer, the term of this patent is extended or adjusted under 35 U.S.C. 154(b) by 0 days.

(21) Appl. No.: 09/429,171

(22) Filed: Oct. 28, 1999

(30) Foreign Application Priority Data

Oct. 30, 1998 (JP) ..... 10-310500

(51) Int. Cl.[7] ..... F01C 1/04; F01C 11/00; F01C 21/06

(52) U.S. Cl. ..... 418/5; 418/55.5; 418/60; 418/83; 418/188; 417/410.5

(58) Field of Search ..... 418/55.2, 60, 188, 418/55.5, 57, 83, 5; 417/410.5, 243

(56) References Cited

U.S. PATENT DOCUMENTS 3,924,977 * 12/1975 McCullough ..... 418/55.5
4,515,539 * 5/1985 Morishita ..... 418/60
4,553,913 * 11/1985 Morishita et al. ..... 418/60
5,447,418 * 9/1995 Takeda et al. ..... 418/55.5
6,030,192 * 2/2000 Hill et al. ..... 418/55.5

FOREIGN PATENT DOCUMENTS 57-24486 2/1982 (JP) .
64-29688 * 1/1989 (JP) ..... 418/188
4-121474 * 4/1992 (JP) ..... 418/60
4-121478 * 4/1992 (JP) ..... 418/60

* cited by examiner

*Primary Examiner*—John J. Vrablik
(74) *Attorney, Agent, or Firm*—Wenderoth, Lind & Ponack, L.L.P.

(57) ABSTRACT

A scroll fluid machine requiring no crank shaft to orbitably support an orbiting scroll member and capable of being reduced in overall size in the axial direction. In a casing, two fixed scroll members are provided on the axis of the casing, and an electric motor is provided between the fixed scroll members. Eccentric bearings each having an outer ring, an intermediate ring and an inner ring are provided between the electric motor and the fixed scroll members. The inner periphery of each intermediate ring is formed with an axis eccentric with respect to the axis of the casing. Orbiting scroll members are integrated with the inner rings through an orbiting shaft. The orbiting shaft is caused to orbit by rotating a rotating shaft with the electric motor, thereby causing the orbiting scroll members to orbit relative to the fixed scroll members.

12 Claims, 6 Drawing Sheets

SCROLL FLUID MACHINE HAVING SCROLL MEMBERS AT EACH END OF A ROTATING HOLLOW SHAFT

BACKGROUND OF THE INVENTION

The present invention relates to a scroll fluid machine suitable for use in an air compressor, a vacuum pump, etc. by way of example.

In general, a scroll fluid machine has a casing and a fixed scroll member provided in the casing. A driving shaft is rotatably provided in the casing. An orbiting scroll member is orbitably provided on the distal end of the driving shaft in the casing to come in sliding contact with the fixed scroll member in the axial direction. A plurality of compression chambers are defined between the orbiting scroll member and the fixed scroll member [for example, see Japanese Patent Application Unexamined Publication (KOKAI) Nos. 6-26484 (1994) and 9-144674 (1997)].

In this type of conventional scroll fluid machine, the driving shaft is externally driven to rotate, causing the orbiting scroll member to perform an orbiting motion with a predetermined eccentricity with respect to the fixed scroll member, thereby sucking a fluid, e.g. air, from a suction opening provided at the outer periphery of the fixed scroll member, and successively compressing the fluid in the compression chambers formed between the wrap portions of the fixed and orbiting scroll members. Finally, the compressed fluid is discharged to the outside from a discharge opening provided in the center of the fixed scroll member.

Incidentally, in the above-described conventional scroll fluid machine, a crank shaft is provided at the distal end of the driving shaft at a position eccentric with respect to the axis of the driving shaft to orbitably support the orbiting scroll member at the distal end of the driving shaft. The crank shaft is integral with the driving shaft or provided as a member separate from the driving shaft.

Accordingly, the overall length of the driving shaft becomes extra longer by the length of the crank shaft. This causes the whole apparatus to increase in size in the axial direction unfavorably.

In view of the above-described problems with the prior art, an object of the present invention is to provide a scroll fluid machine designed to eliminate the need for a crank shaft for orbitably supporting an orbiting scroll member and to enable a reduction in overall length in the axial direction.

SUMMARY OF THE INVENTION

To attain the above-described object, the present invention provides a scroll fluid machine arranged as stated below.

The scroll fluid machine includes a stationary member having a casing and two fixed scroll members fixedly provided in the casing at both ends of the casing. The two fixed scroll members are centered on the axis of the casing. Each of the fixed scroll members has a spiral wrap portion standing on an end plate. An electric motor is provided in the casing between the two fixed scroll members. The electric motor has a rotor and a stator which are so arranged that their axes extend parallel with the axis of the casing. Two eccentric bearings are provided in association with the two fixed scroll members. Each of the two eccentric bearings includes an outer ring provided between the electric motor and the associated fixed scroll member and fixedly fitted at the outer periphery thereof to the casing. An intermediate ring is rotatably provided at the inner peripheral side of the outer ring. The inner periphery of the intermediate ring has an eccentric axis radially displaced relative to the axis of the outer ring. An inner ring is rotatably provided at the inner peripheral side of the intermediate ring. The inner ring is rotatable about the eccentric axis. A rotating shaft is provided to extend between the intermediate rings of the two eccentric bearings through the rotor of the electric motor. The rotating shaft is formed from a hollow shaft member and rotatable together with the intermediate rings as one unit by the rotor. An orbiting shaft is loosely fitted in the rotating shaft. The axis of the orbiting shaft is coincident with the eccentric axis. The orbiting shaft is fixedly supported by the inner rings of the two eccentric bearings so as to perform an orbiting motion together with the inner rings as one unit. Two orbiting scroll members are connected to both ends of the orbiting shaft to face the fixed scroll members, respectively. Each of the orbiting scroll members has a spiral wrap portion standing on an end plate so as to overlap the wrap portion of the associated fixed scroll member to define a plurality of compression chambers. In addition, a rotation preventing mechanism is provided between at least either one of the two orbiting scroll members and the stationary member to prevent rotation of the orbiting scroll members.

DETAILED DESCRIPTION OF THE INVENTION

A scroll fluid machine according to a first embodiment of the present invention will be described below in detail with reference to the accompanying drawings. In the first embodiment, the present invention is applied to a scroll air compressor as an example of scroll fluid machines.

Figure 1:
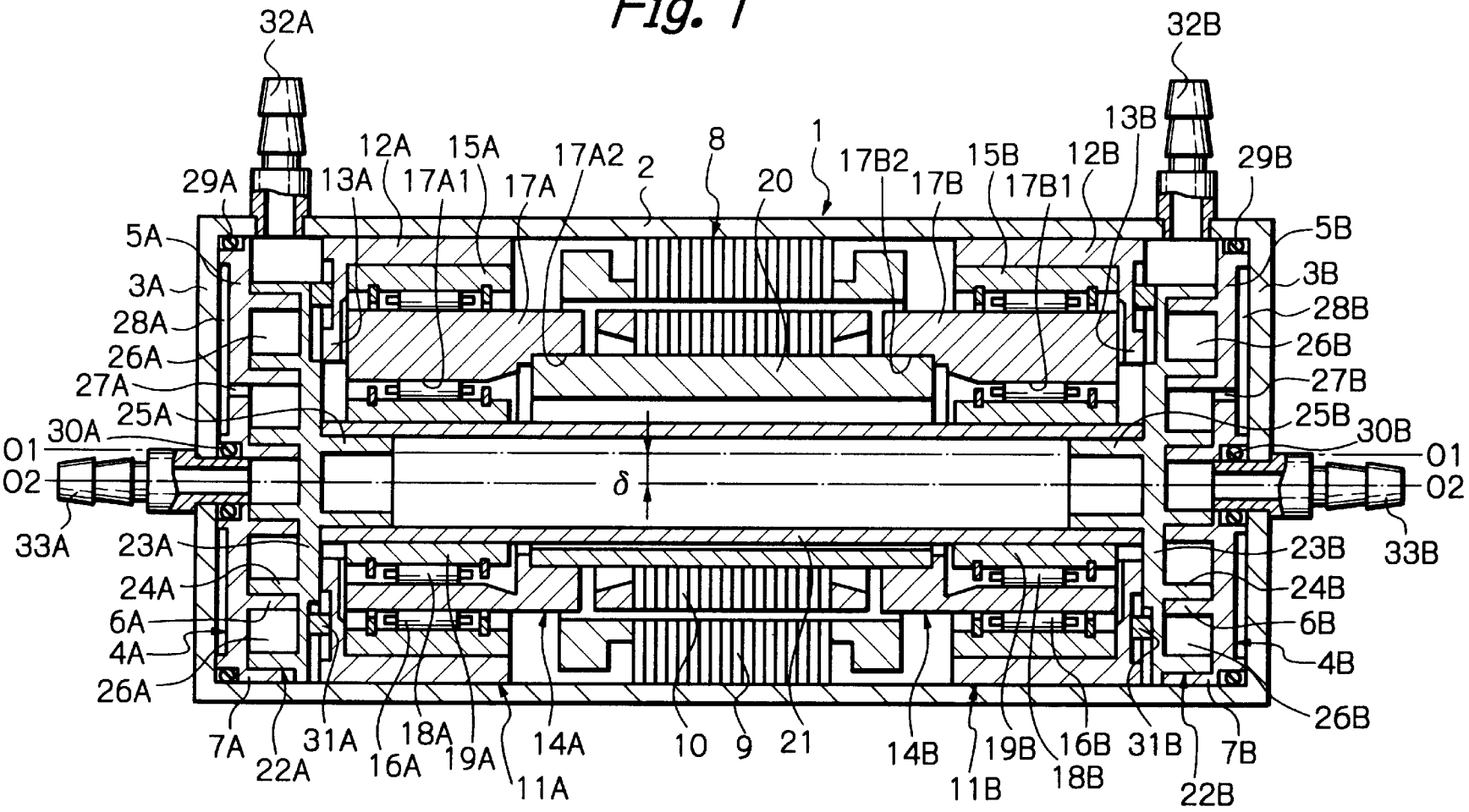
FIG. 1 is a longitudinal sectional view of a scroll air compressor according to a first embodiment of the present invention.

FIGS. 1 to 6 show the first embodiment of the present invention. A cylindrical casing 1 forms an outer frame of a scroll air compressor. As shown in FIG. 1, the casing 1 has a cylindrical portion 2 with an axis O1—O1. Left and right cover portions 3A and 3B cover both ends of the cylindrical portion 2. The casing 1 constitutes a stationary member in combination with fixed scroll members 4A and 4B.

The fixed scroll members 4A and 4B are provided on the inner peripheral side of the cylindrical portion 2 at respective (left and right) axial ends of the casing 1. As shown in FIG. 1, one fixed scroll member 4A has an end plate 5A formed in an approximately disk-like shape. The end plate 5A is positioned so that the center thereof is coincident with the axis O1—O1 of the casing 1. A spiral wrap portion 6A is provided on the front side of the end plate 5A. In addition, a fitting cylindrical portion 7A projects axially from the outer peripheral edge of the end plate 5A in the same direction as the direction in which wrap portion 6A projects. The fitting cylindrical portion 7A is fixedly fitted to the inner periphery of the cylindrical portion 2.

The other fixed scroll member 4B similarly has an end plate 5B, a wrap portion 6B and a fitting cylindrical portion 7B.

An electric motor 8 is provided in the middle of the casing 1 between the fixed scroll members 4A and 4B. The electric motor 8 has a stator 9 fixedly provided on the inner periphery of the casing 1. A rotor 10 is disposed at the inner peripheral side of the stator 9 so as to be rotatable by the stator 9. The axes of both the stator 9 and the rotor 10 are coincident with the axis O1—O1 of the casing 1.

Left and right thrust bearings 11A and 11B are provided at the inner peripheral side of the casing 1 between the electric motor 8 and the fixed scroll members 4A and 4B, respectively. One thrust bearing 11A has a mounting cylinder 12A rigidly attached to the inner periphery of the cylindrical portion 2 of the casing 1. An annular projection 13A projects radially inward from the mounting cylinder 12A at the rear side of an end plate 23A of an orbiting scroll member 22A (described later). The thrust bearing 11A bears a thrust load acting on the orbiting scroll member 22A and also forms grooves of an Oldham's ring (described later).

The other thrust bearing 11B similarly has a mounting cylinder 12B and an annular projection 13B.

Figure 2:
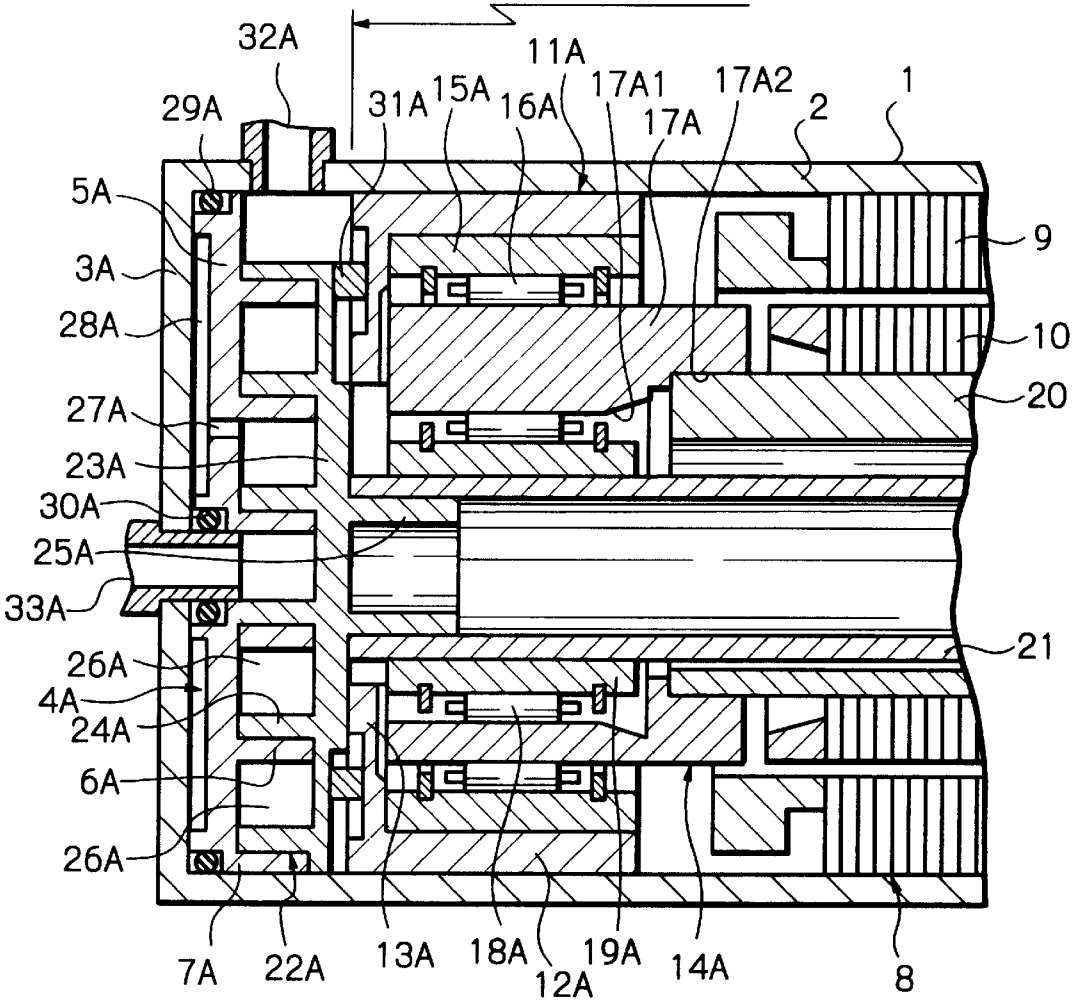
FIG. 2 is an enlarged fragmentary sectional view of a fixed scroll member, an eccentric bearing, a rotating shaft, an orbiting scroll member, etc. in the scroll air compressor shown in FIG. 1.
Figure 3:
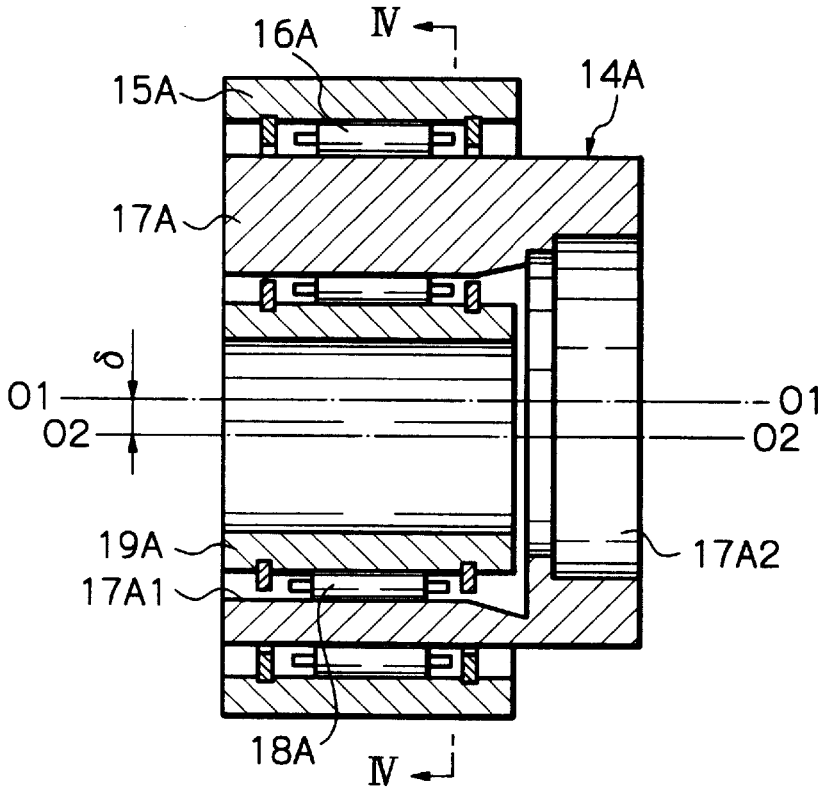
FIG. 3 is a sectional view showing the eccentric bearing in FIG. 2 in the form of a single element.
Figure 4:
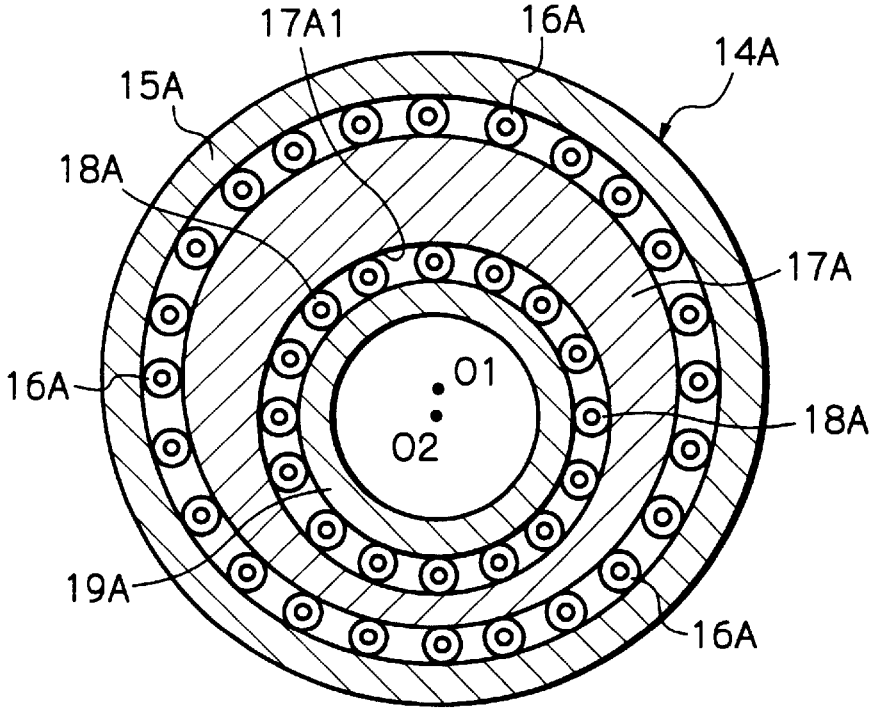
FIG. 4 is a sectional view as seen in the direction of the arrow IV—IV in FIG. 3.

Left and right eccentric bearings 14A and 14B are provided on the inner peripheral sides of the thrust bearings 11A and the 11B at respective positions between the electric motor 8 and the fixed scroll members 4A and 4B. As shown in FIGS. 2 to 4, one eccentric bearing 14A has an outer ring 15A and an intermediate ring 17A rotatably provided at the inner peripheral side of the outer ring 15A through a plurality of needle rollers 16A. In addition, an inner ring 19A is rotatably provided at the inner peripheral side of the intermediate ring 17A through a plurality of needle rollers 18A.

The outer ring 15A is press-fitted at the outer periphery thereof to the inner periphery of the mounting cylinder 12A of the thrust bearing 11A. Thus, the axes of both the inner and outer peripheries of the outer ring 15A are coincident with the axis O1—O1.

The intermediate ring 17A is positioned at the inner peripheral side of the outer ring 15A by the needle rollers 16A. Thus, the axis of the outer periphery of the intermediate ring 17A is coincident with the axis O1—O1 of the outer ring 15A. Consequently, the intermediate ring 17A rotates about the axis O1—O1.

The intermediate ring 17A has an axial bore 17A1 for accommodating the inner ring 19A, and the accommodating bore 17A1 has an eccentric axis O2—O2 that is radially displaced relative to the axis O1—O1 of the outer ring 15A by a predetermined dimension a. In addition, the inner periphery of the intermediate ring 17A is formed with a mounting step portion 17A2 to which a rotating shaft 20 (described later) is secured. The axis of the mounting step portion 17A2 is coincident with the axis O1—O1.

The inner ring 19A is positioned at the inner peripheral side of the intermediate ring 17A by the needle rollers 18A. Thus, the axes of both the inner and outer peripheries of the inner ring 19A are coincident with the eccentric axis O2—O2. Consequently, the inner ring 19A rotates about the eccentric axis O2—O2.

Thus, in the eccentric bearing 14A, the intermediate ring 17A is caused to rotate relative to the outer ring 15A by the rotating shaft 20, and this causes the inner ring 19A to perform an orbiting motion with an orbiting radius ä about the axis O1—O1.

The other eccentric bearing 14B similarly has an outer ring 15B, needle rollers 16B, an intermediate ring 17B, needle rollers 18B and an inner ring 19B, and the intermediate ring 17B is provided with an accommodating bore 17B1 and a mounting step portion 17B2.

The rotating shaft 20 is provided to extend between the intermediate rings 17A and 17B of the eccentric bearings 14A and 14B. The rotating shaft 20 is formed in the shape of a hollow shaft member and fixedly fitted to the inner periphery of the rotor 10 of the electric motor 8. Both ends of the rotating shaft 20 are rigidly secured to the respective mounting step portions 17A2 and 17B2 of the intermediate rings 17A and 17B. The rotating shaft 20 rotates together with the rotor 10 as one unit, thus causing the intermediate rings 17A and 17B to rotate.

Figure 5:
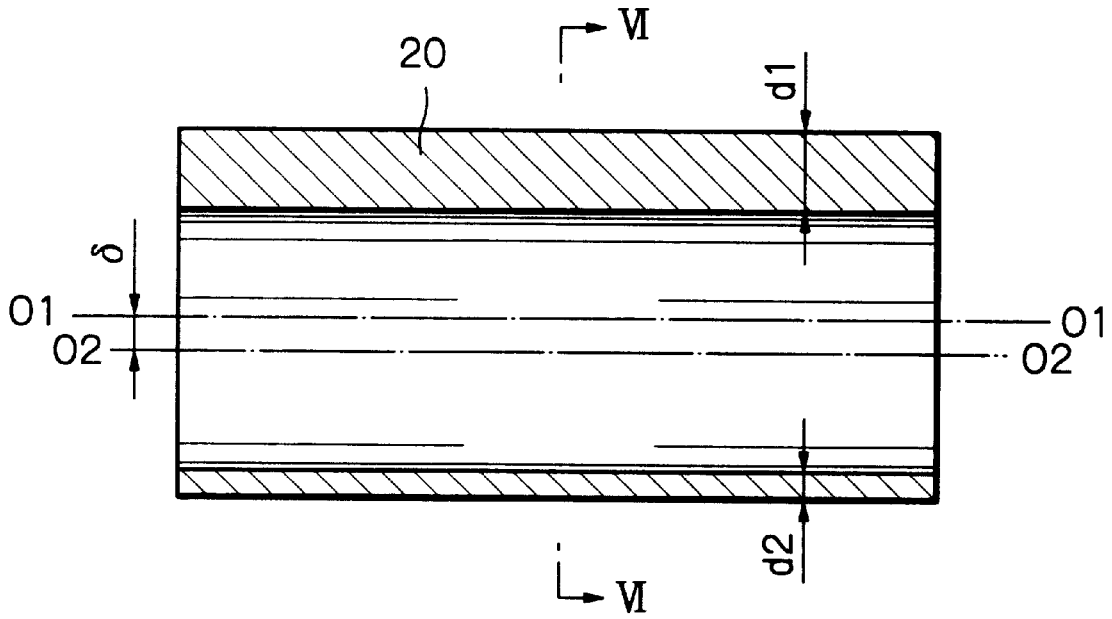
FIG. 5 is an enlarged sectional view showing the rotating shaft in FIG. 1 in the form of a single element.
Figure 6:
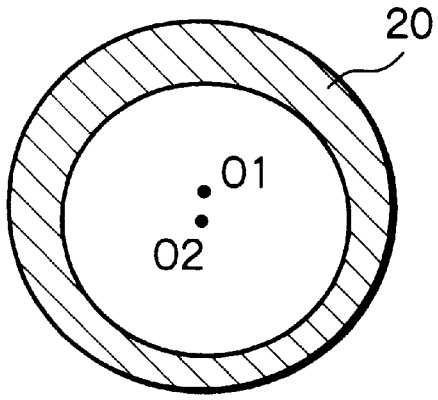
FIG. 6 is a sectional view as seen in the direction of the arrow VI—VI in FIG. 5.

As shown in FIG. 5, the axis of the outer periphery of the rotating shaft 20 is coincident with the common axis O1—O1 of the outer rings 15A and 15B, whereas the axis of the inner periphery of the rotating shaft 20 is coincident with the common eccentric axis O2—O2 of the intermediate rings 17A and 17B. Accordingly, assuming that the wall thickness of a part of the rotating shaft 20 on the side of the axis O1—O1 remote from the eccentric axis O2—O2 is dl and the wall thickness of a part of the rotating shaft 20 on the side closer to the eccentric axis O2—O2 is d2, the relationship between the two wall thicknesses is expressed by d1>d2.

An orbiting shaft 21 is loosely fitted in the rotating shaft 20 and fixedly supported by the inner rings 19A and 19B of the eccentric bearings 14A and 14B. The axis of the orbiting shaft 21 is coincident with the eccentric axis O2—O2. Both ends of the orbiting shaft 21 are fitted to the respective inner peripheries of the inner rings 19A and 19B and rigidly secured thereto. The orbiting shaft 21 performs an orbiting motion together with the inner rings 19A and 19B as one unit, thereby causing orbiting scroll members 22A and 22B (described later) provided on both ends of the orbiting shaft 21 to perform an orbiting motion.

As shown in FIG. 2, the axial length L of the orbiting shaft 21 is set at a value approximately equal to or slightly greater than the distance between the annular projections 13A and 13B of the thrust bearings 11A. Consequently, the front sides of the thrust bearings 11A and 11B and the rear sides of the associated end plates 23A and 23B of the orbiting scroll members 22A and 22B are in contact with each other or have a slight gap, for example, of about 10 micrometers therebetween.

Thus, both ends of the orbiting shaft 21 abut on the respective end plates 23A and 23B of the orbiting scroll members 22A and 22B to serve as a spacer for positioning the orbiting scroll members 22A and 22B with respect to the axial direction.

The left and right orbiting scroll members 22A and 22B are fixedly provided on the two axial ends of the orbiting shaft 21 to face the fixed scroll members 4A and 4B, respectively. As shown in FIGS. 1 and 2, one orbiting scroll member 22A has an end plate 23A formed in a disk-like shape and a spiral wrap portion 24A provided on the front side of the end plate 23A to extend axially.

The end plate 23A of the orbiting scroll member 22A has a cylindrical projection 25A projecting from the center of the rear side thereof. The cylindrical projection 25A is fitted to the inner periphery of the orbiting shaft 21 and rigidly secured thereto. Thus, the orbiting scroll member 22A performs an orbiting motion with an orbiting radius ä together with the orbiting shaft 21 as one unit. The orbiting scroll member 22A is positioned so that the wrap portion 24A overlaps the wrap portion 6A of the fixed scroll member 4A with an offset angle of 180 degrees, for example. Thus, a plurality of compression chambers 26A are defined between the two wrap portions 6A and 24A.

During the operation of the scroll air compressor, air is sucked into the outermost compression chamber 26A from a suction opening 32A (described later), and the sucked air is successively compressed in the compression chambers 26A during the orbiting motion of the orbiting scroll member 22A. Finally, the compressed air is discharged from the central compression chamber 26A to the outside through a discharge opening 33A (described later).

The other orbiting scroll member 22B similarly has an end plate 23B, a wrap portion 24B and a cylindrical projection 25B, and a plurality of compression chambers 26B are defined between the orbiting scroll member 22B and the fixed scroll member 4B.

Left and right back-pressure bores 27A and 27B are provided in the end plates 5A and 5B of the fixed scroll members 4A and 4B, respectively. One back-pressure bore 27A communicates with an intermediate compression chamber 26A between the outermost compression chamber 26A, which is the closest to the suction opening 32A, and the innermost compression chamber 26A, which is the closest to the discharge opening 33A. The back-pressure bore 27A leads an intermediate pressure from the intermediate compression chamber 26A to a pressure chamber 28A (described later) as a back pressure. The other back-pressure bore 27B is arranged as in the case of the back-pressure bore 27A.

Left and right pressure chambers 28A and 28B are formed between the cover portions 3A and 3B of the casing 1 and the end plates 5A and 5B of the fixed scroll members 4A and 4B, respectively. One pressure chamber 28A leads an intermediate pressure from the compression chambers 26A to the rear side of the end plate 5A through the back-pressure bore 27A. With the intermediate pressure, the fixed scroll member 4A is pressed axially toward the orbiting scroll member 22A. The other pressure chamber 28B is arranged as in the case of the pressure chamber 28A.

O-rings 29A and 29B are provided between the casing 1 and the respective outer peripheries of the end plates 5A and 5B of the fixed scroll members 4A and 4B. The O-rings 29A and 29B provide hermetic sealing between the outermost compression chambers 26A and 26B and the pressure chambers 28A and 28B.

O-rings 30A and 30B are provided in respective areas between the central portions of the end plates 5A and 5B of the fixed scroll members 4A and 4B and the discharge openings 33A and 33B. The O-rings 30A and 30B provide hermetic sealing between the innermost compression chambers 26A and 26B and the pressure chambers 28A and 28B.

Oldham's rings 31A and 31B are provided between the thrust bearings 11A and 11B and the orbiting scroll members 22A and 22B, respectively, to serve as rotation preventing mechanisms. One Oldham's ring 31A is guided in two orthogonal axis directions between the annular projection 13A of the thrust bearing 11A and the end plate 23A of the orbiting scroll member 22A, thereby preventing rotation of the orbiting scroll member 22A. The other Oldham's ring 31B is arranged as in the case of the Oldham's ring 31A. The arrangement and operation of the Oldham's rings 31A and 31B per se are well known.

The suction openings 32A and 32B are provided in the cylindrical portion 2 of the casing 1 at respective positions facing the outer peripheries of the wrap portions 6A and 6B of the fixed scroll members 4A and 4B. The suction opening 32A opens in the outermost compression chamber 26A to lead the outside air into the compression chamber 26A. The other suction opening 32B is arranged as in the case of the suction opening 32A.

The discharge openings 33A and 33B are provided in the cover portions 3A and 3B of the casing 1 at respective positions facing the centers of the wrap portions 6A and 6B of the fixed scroll members 4A and 4B. One discharge opening 33A opens in the innermost compression chamber 26A to discharge the compressed air, which has been compressed in the compression chambers 26A, to the outside. The other discharge opening 33B is arranged as in the case of the discharge opening 33A.

The scroll air compressor according to this embodiment has the above-described arrangement. Next, the operation of the scroll air compressor will be described.

As the rotor 10 of the electric motor 8 rotates, the rotating shaft 20, which is integral with the rotor 10, performs a rotational motion. At this time, the intermediate rings 17A and 17B of the two eccentric bearings 14A and 14B, which are provided on both ends of the rotating shaft 20, perform a rotational motion together with the rotating shaft 20 as one unit at the inner peripheral sides of the outer rings 15A and 15B.

The inner peripheries of the intermediate rings 17A and 17B of the eccentric bearings 14A and 14B have the common eccentric axis O2—O2, which is radially displaced relative to the common axis O1—O1 of the outer rings 15A and 15B by the dimension ä. Therefore, as the intermediate rings 17A and 17B rotate about the axis O1—O1 relative to the outer rings 15A and 15B as stated above, the inner rings 19A and 19B, which are provided at the inner peripheral sides of the intermediate rings 17A and 17B, perform an orbiting motion with an orbiting radius a about the axis O1—O1. Thus, the orbiting shaft 21, which is integral with the inner rings 19A and 19B, causes the orbiting scroll members 22A and 22B to orbit.

When orbiting as stated above, the orbiting scroll members 22A and 22B are prevented from rotating by the respective Oldham's rings 31A and 31B. Thus, the orbiting scroll members 22A and 22B only revolve around the axis O1—O1.

Consequently, the compression chambers 26A, which are defined between the fixed scroll member 4A and the orbiting scroll member 22A, are continuously contracted. Thus, the outside air sucked in from the suction opening 32A of the fixed scroll member 4A is successively compressed in the compression chambers 26A, and the compressed air is discharged from the discharge opening 33A of the fixed scroll member 4A and stored in an external air tank or the like (not shown).

The compression chambers 26B, which are defined between the fixed scroll member 4B and the orbiting scroll member 22B, are also continuously contracted. Thus, the outside air sucked in from the suction opening 32B of the fixed scroll member 4B is successively compressed in the compression chambers 26B, and the compressed air is discharged from the discharge opening 33B of the fixed scroll member 4B and stored in the external air tank or the like.

Thus, in this embodiment, both ends of the orbiting shaft 21 are orbitably supported by the eccentric bearings 14A and 14B, whereby the orbiting scroll members 22A and 22B, which are integrally provided on the two ends of the orbiting shaft 21, can be driven to orbit. Accordingly, it is possible to eliminate the need to additionally provide a crank shaft at each end of the orbiting shaft 21, as stated in regard to the prior art, in order to cause the orbiting scroll members 22A and 22B to perform an orbiting motion. Thus, the whole apparatus can be reduced in size in the axial direction.

In addition, the scroll air compressor comprises two compression mechanisms consisting essentially of the fixed scroll members 4A and 4B and the orbiting scroll members 22A and 22B. Therefore, it is possible to reduce the number of turns of the wrap portions 6A, 6B, 24A and 24B in comparison to a compressor having the same capacity as that of the compressor according to the embodiment and comprising one compression mechanism consisting essentially of one set of scroll members as in the prior art. Accordingly, the whole apparatus can be reduced in size in the radial direction.

In addition, the axial length L of the orbiting shaft 21 is set so that the orbiting scroll members 22A and 22B and the front sides of the thrust bearings 11A and 11B are in contact with each other or have a slight gap therebetween. Accordingly, it is possible to reduce the sliding resistance acting between the thrust bearings 11A and 11B and the orbiting scroll members 22A and 22B during the compression operation and hence possible to prevent the sliding surfaces of these members from wearing at a high rate.

In addition, thrust loads acting on the orbiting scroll members 22A and 22B can be transmitted to the orbiting shaft 21 in the opposite directions to each other. Thus, these thrust loads can be canceled by each other in the axial direction. Consequently, the orbiting shaft 21 can bear the thrust loads between the orbiting scroll members 22A and 22B, and the orbiting scroll members 22A and 22B can be positioned with respect to the axial direction. Accordingly, it is possible to stabilize the behavior of the orbiting scroll members 22A and 22B.

When a run-out of end face occurs in the orbiting scroll members 22A and 22B during the compression operation, the end plates 23A and 23B of the orbiting scroll members 22A and 22B are brought into sliding contact with the thrust bearings 11A and 11B, thereby allowing a part of thrust loads acting on the orbiting scroll members 22A and 22B to be borne by the thrust bearings 11A and 11B. Thus, the behavior of the orbiting scroll members 22A and 22B can be stabilized even more effectively.

In addition, the rotating shaft 20, which is a hollow shaft member, has a larger wall thickness at a part thereof on a side opposite to a decentration side toward which the common axis of the orbiting scroll members 22A and 22B is radially displaced relative to the axis O1—O1 than at a part of the rotating shaft on the decentration side. Therefore, the orbiting motion of the orbiting scroll members 22A and 22B can be balanced by the rotating shaft 20. Consequently, it becomes unnecessary to provide a special mechanism, e.g. a balance weight, on the rotating shaft 20 and hence possible to reduce the number of components and to simplify the structure of the whole apparatus.

In addition, the pressure chambers 28A and 28B are provided at the rear of the fixed scroll members 4A and 4B, and intermediate pressures in the compression chambers 26A and 26B are led into the pressure chambers 28A and 28B, respectively. Accordingly, the fixed scroll members 4A and 4B can be continuously pressed toward the end plates 23A and 23B of the orbiting scroll members 22A and 22B. Thus, it is possible to suppress variations in the gaps in the thrust direction between the distal ends of the wrap portions 6A and 6B and the surfaces of the associated end plates 23A and 23B and hence possible to increase the compression efficiency.

Figure 7:
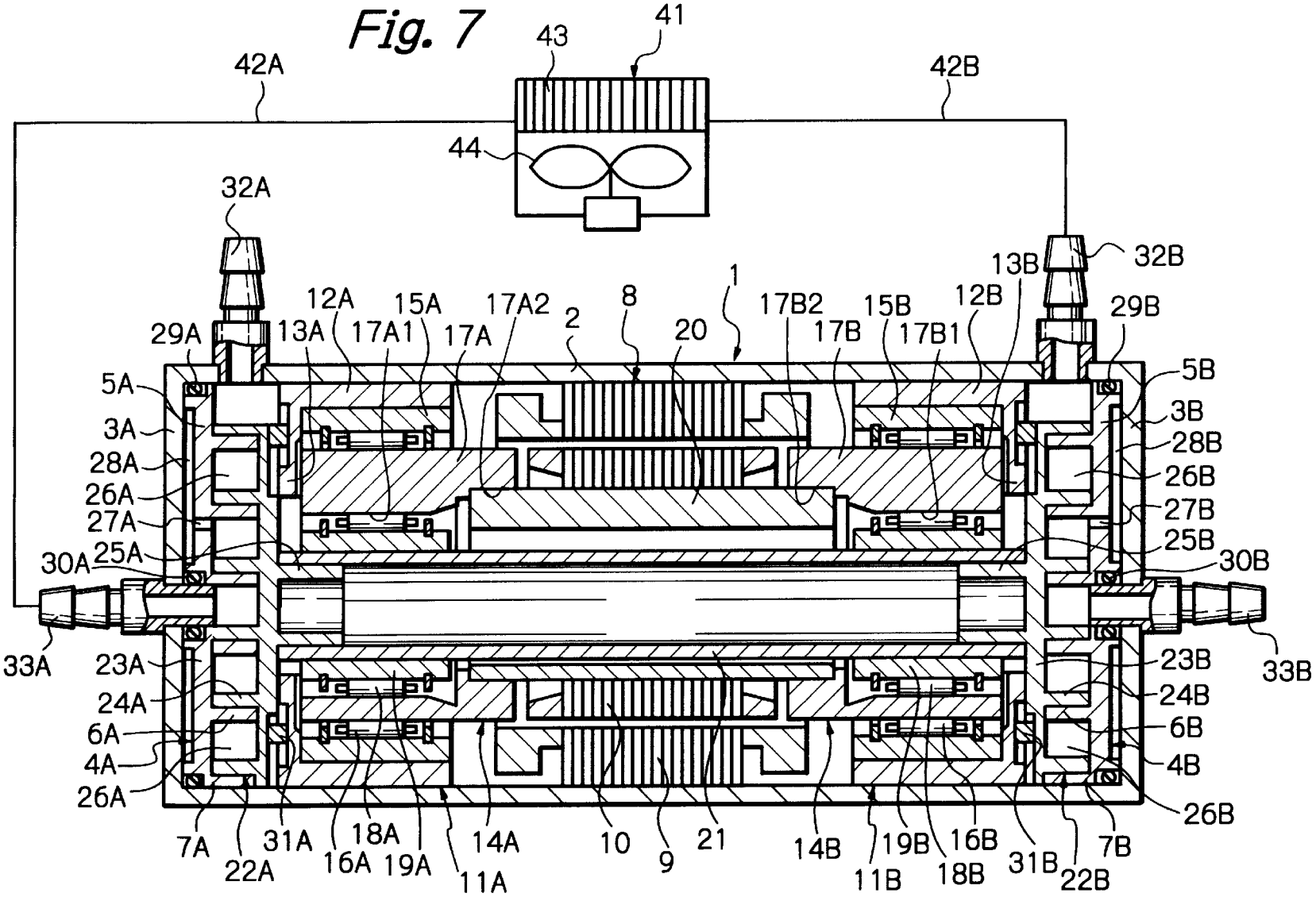
FIG. 7 is a longitudinal sectional view of a scroll air compressor according to a second embodiment of the present invention.

FIG. 7 shows a second embodiment of the present invention. In this embodiment, the same constituent elements as those in the first embodiment are denoted by the same reference numerals, and a description thereof is omitted. The feature of this embodiment resides in that an intercooler 41 is provided outside the casing 1 at a position between the discharge opening 33A of the fixed scroll member 4A and the suction opening 32B of the fixed scroll member 4B, and the discharge opening 33A and the intercooler 41 are connected by a connecting pipe 42A, and further the suction opening 32B and the intercooler 41 are connected by another connecting pipe 42B.

The intercooler 41 is, for example, a cooling device having a heat exchanger 43, a fan 44, etc. and adapted to cool high-temperature compressed air discharged from the discharge opening 33A and lead the cooled compressed air to the suction opening 32B.

In the second embodiment arranged as stated above, the outside air can be successively compressed by two compression mechanisms comprising the fixed scroll members 4A and 4B and the orbiting scroll members 22A and 22B. Thus, it is possible to improve the compression performance without increasing the number of turns of the wrap portions 6A, 6B, 24A and 24B and hence possible to provide a compressor having a reduced diameter.

Moreover, in this embodiment, high-temperature compressed air discharged from the discharge opening 33A of the fixed scroll member 4A can be led to the suction opening 32B of the fixed scroll member 4B in the state of being pre-cooled by the intercooler 41. Accordingly, the overall compression efficiency of the apparatus can be increased.

Figure 8:
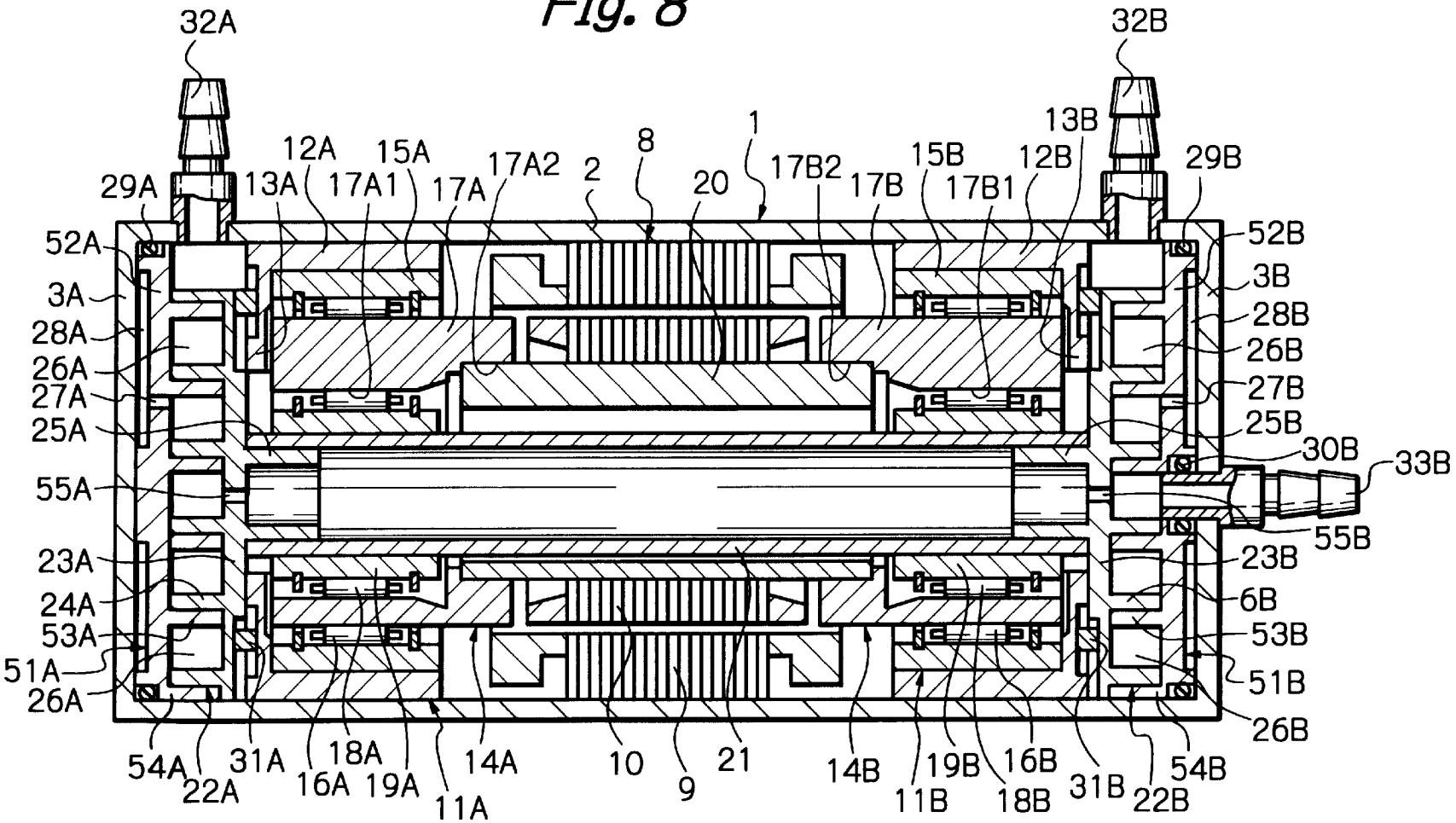
FIG. 8 is a longitudinal sectional view of a scroll air compressor according to a third embodiment of the present invention.

FIG. 8 shows a third embodiment of the present invention. The feature of this embodiment resides in that one of the fixed scroll members has no discharge opening, and the end plate of each orbiting scroll members is provided in the center thereof with a communicating bore that communicates with the inside of the orbiting shaft. It should be noted that in the third embodiment the same constituent elements as those in the first embodiment are denoted by the same reference numerals, and a description thereof is omitted.

Reference numerals 51A and 51B denote left and right fixed scroll members used in this embodiment, which are provided in the casing 1. One fixed scroll member 51A is arranged approximately in the same way as in the case of the fixed scroll member 4A in the first embodiment. That is, the fixed scroll member 51A has an approximately disk-shaped end plate 52A and a spiral wrap portion 53A provided on the front side of the end plate 52A. In addition, a fitting cylindrical portion 54A is provided on the outer peripheral edge of the end plate 52A. The fixed scroll member 51A differs from the fixed scroll member 4A in the first embodiment in that the fixed scroll member 51A is not provided with the discharge opening 33A.

The other fixed scroll member 51B similarly has an end plate 52B, a wrap portion 53B and a fitting cylindrical portion 54B. However, unlike the fixed scroll member 51A, the fixed scroll member 51B is provided with a discharge opening 33B.

Communicating bores 55A and 55B are provided in the respective centers of the end plates 23A and 23B of the orbiting scroll members 22A and 22B. The communicating bores 55A and 55B provide communication between the compression chambers 26A on the orbiting scroll member 22A and the compression chambers 26B on the orbiting scroll member 22B through the inside of the orbiting shaft 21.

Accordingly, compressed air from the compression chambers 26A is led to the compression chambers 26B through the orbiting shaft 21 and discharged from the discharge opening 33B to the outside, together with compressed air produced in the compression chambers 26B.

Thus, the third embodiment arranged as described above also provides advantageous effects approximately similar to those of the first embodiment. In particular, the third embodiment makes it unnecessary to provide the fixed scroll member 51A with the discharge opening 33A as stated in regard to the first embodiment and also unnecessary to provide a connecting pipe or the like for connection between the discharge opening 33A and the air tank. Thus, the structure of the whole apparatus can be simplified.

Although in the foregoing embodiments two Oldham's rings are used to prevent rotation of the two orbiting scroll members, it should be noted that the present invention is not necessarily limited to the described arrangement. For example, one of the two Oldham's rings may be omitted. In such a case also, each orbiting scroll member performs an orbiting motion together with the orbiting shaft as one unit. Therefore, the two orbiting scroll members can be simultaneously prevented from rotating by the remaining Oldham's ring.

Although in the foregoing embodiments, the scroll air compressor comprises two compression mechanisms each consisting essentially of a fixed scroll member and an orbiting scroll member, the present invention is not necessarily limited to the described arrangement. For example, one of the two compression mechanisms may be omitted. That is, the scroll air compressor may comprise only one compression mechanism.

Although in the foregoing embodiments the present invention has been described with regard to a scroll air compressor as an example of scroll fluid machines, the present invention is not necessarily limited to the scroll air compressor, but may also be widely applied to other scroll fluid machines, e.g. vacuum pumps, refrigerant compressors, etc.

As has been detailed above, according to one aspect of the present invention, a fixed scroll member and an electric motor are disposed in a casing on the axis of the casing at a distance from each other. An eccentric bearing having an outer ring, an intermediate ring and an inner ring is provided between the electric motor and the fixed scroll member. The intermediate ring is rotated by rotating a rotating shaft that is integral with the electric motor. The rotation of the intermediate ring causes an orbiting shaft, which is integral with the inner ring, to perform an orbiting motion, thereby causing an orbiting scroll member to orbit. Therefore, it is possible to eliminate the need to additionally provide a crank shaft on the orbiting shaft as stated in regard to the prior art in order to cause the orbiting scroll member to orbit. Thus, the whole apparatus can be reduced in size in the axial direction and formed in a compact structure.

According to another aspect of the present invention, two fixed scroll members are provided in a casing on the axis of the casing away from each other with an electric motor interposed therebetween. Two eccentric bearings each having an outer ring, an intermediate ring and an inner ring are provided between the electric motor and the two fixed scroll members, respectively. The intermediate rings are rotated by rotating a rotating shaft that is integral with the electric motor. The rotation of the intermediate rings causes an orbiting shaft, which is integral with the inner rings, to perform an orbiting motion, thereby causing two orbiting scroll members to orbit. Therefore, it is possible to eliminate the need to provide a crank shaft on the orbiting shaft to cause the orbiting scroll members to orbit. Thus, the whole apparatus can be reduced in size in the axial direction and formed in a compact structure.

Moreover, during the compression operation, a thrust load acting on one orbiting scroll member and a thrust load acting on the other orbiting scroll member can be transmitted to the orbiting shaft in the opposite directions to each other. Thus, these thrust loads can be canceled by each other in the axial direction. Consequently, the thrust loads can be borne between the orbiting shaft and the orbiting scroll members, and the behavior of the orbiting scroll members can be stabilized.

In the present invention, two thrust bearings may be provided at the inner peripheral side of the casing to bear thrust loads acting on the orbiting scroll members, and the orbiting shaft may have a length set so that the rear side of each orbiting scroll member and the front side of the associated thrust bearing are in contact with each other or have a slight gap therebetween. With this arrangement, thrust loads acting on the orbiting scroll members can be canceled by each other in the axial direction. In addition, the thrust loads can be borne by the orbiting shaft, and thus the behavior of the orbiting scroll members can be stabilized.

Even when a run-out of end face occurs in the orbiting scroll members during the compression operation, the end plates of the orbiting scroll members are brought into sliding contact with the thrust bearings, thereby allowing a part of thrust loads acting on the orbiting scroll members to be borne by the thrust bearings. Thus, the behavior of the orbiting scroll members can be stabilized.

In the present invention, the rotating shaft may have a larger wall thickness at a part thereof on a side opposite to a decentering side toward which the orbiting scroll members are decentered than at a part of the rotating shaft on the decentering side. With this arrangement, the orbiting motion of the orbiting scroll members can be balanced by the rotating shaft. Consequently, it becomes unnecessary to provide a special mechanism, e.g. a balance weight, on the rotating shaft and hence possible to reduce the number of components and to simplify the structure of the whole apparatus.

In the present invention, each of the orbiting scroll members may have a communicating bore formed in the center of its end plate so that the communicating bore communicates with the inside of the orbiting shaft. With this arrangement, one of the fixed scroll members need not be provided with a discharge opening and a connecting pipe or the like to be connected to this discharge opening. Thus, the structure of the whole apparatus can be simplified.

In the present invention, the scroll fluid machine may be arranged such that a disc harge opening provided for one of the fixed scroll members is connected to an intercooler, and a suction opening provided for the other of the fixed scroll members is connected to the intercooler. With this arrangement, the outside air can be successively compressed by two compression mechanisms each comprising a fixed scroll member and an orbiting scroll member. Thus, it is possible to improve the compression performance without increasing the number of turns of the wrap portions and hence possible to provide a compressor having a reduced diameter. In addition, high-temperature compressed air discharged from the discharge opening for the one fixed scroll member can be led to the suction opening for the other fixed scroll member in the state of being pre-cooled by the intercooler. Accordingly, the overall compression efficiency of the apparatus can be increased.

What is claimed is:

1. A scroll fluid machine comprising:

a stationary member including a casing and two fixed scroll members fixedly provided in said casing at both ends of said casing, said two fixed scroll members being centered on an axis of said casing, each of said fixed scroll members having a spiral wrap portion standing on an end plate;

an electric motor provided in said casing between said two fixed scroll members, said electric motor having a rotor and a stator which are so arranged that their axes extend parallel with the axis of said casing;

two eccentric bearings provided in association with said two fixed scroll members, each of said two eccentric bearings including an outer ring provided between said electric motor and the fixed scroll member associated therewith and fixedly fitted at an outer periphery thereof to said casing, and an intermediate ring rotatably provided at an inner peripheral side of said outer ring, an inner periphery of said intermediate ring having an eccentric axis radially displaced relative to an axis of said outer ring, each of said eccentric bearings further including an inner ring rotatably provided at an inner peripheral side of said intermediate ring, said inner ring being rotatable about said eccentric axis;

a rotating shaft formed from a hollow shaft member extending between the intermediate rings of said two eccentric bearings through the rotor of said electric motor, said rotating shaft being rotatable together with said intermediate rings as one unit by said rotor;

an orbiting shaft loosely fitted in said rotating shaft, an axis of said orbiting shaft being coincident with said eccentric axis, said orbiting shaft being fixedly supported by the inner rings of said two eccentric bearings so as to perform an orbiting motion together with said inner rings as one unit;

two orbiting scroll members connected to both ends of said orbiting shaft to face said fixed scroll members, respectively, each of said orbiting scroll members having a spiral wrap portion standing on an end plate so as to overlap the wrap portion of the fixed scroll member associated therewith to define a plurality of compression chambers; and a rotation preventing mechanism provided between at least either one of said two orbiting scroll members and said stationary member to prevent rotation of said orbiting scroll members, wherein each end plate of said fixed scroll members includes a back-pressure bore, and each end plate and back-pressure bore of the fixed scroll members and a portion of said casing define a pressure chamber, and wherein each of the back-pressure bores is positioned so that each of the compression chambers communicates with the corresponding pressure chamber when the compression chamber reaches an intermediate position during the course of movement from a radially outermost position to a radially innermost position such that an intermediate pressure is established in each of the pressure chambers.

2. A scroll fluid machine according to claim 1, wherein said rotating shaft has a larger wall thickness at a part thereof on a side opposite to a decentering side toward which said orbiting scroll member is decentered than at a part of said rotating shaft on said decentering side.

3. A scroll fluid machine according to claim 1, wherein each of said orbiting scroll members has a communicating bore formed in a center of the end plate, said communicating bore communicating with an inside of said orbiting shaft.

4. A scroll fluid machine according to claim 1, further comprising:

suction openings provided in said casing at respective positions facing outer peripheries of the wrap portions of said fixed scroll members;

discharge openings provided in said casing at respective positions facing centers of the wrap portions of said fixed scroll members; and an intercooler provided outside said casing;

wherein the discharge opening provided for one of said fixed scroll members is connected to said intercooler, and the suction opening provided for the other of said fixed scroll members is connected to said intercooler.

5. A scroll fluid machine according to claim 1, wherein said orbiting shaft extends through said inner rings and said orbiting scroll members are fixedly connected to said orbiting shaft.

6. A scroll fluid machine according to claim 5, wherein said rotating shaft has a larger wall thickness at a part thereof on a side opposite to a decentering side toward which said orbiting scroll member is decentered than at a part of said rotating shaft on said decentering side.

7. A scroll fluid machine according to claim 5, wherein each of said orbiting scroll members has a communicating bore formed in a center of the end plate, said communicating bore communicating with an inside of said orbiting shaft.

8. A scroll fluid machine according to claim 5, further comprising:

suction openings provided in said casing at respective positions facing outer peripheries of the wrap portions of said fixed scroll members;

discharge openings provided in said casing at respective positions facing centers of the wrap portions of said fixed scroll members; and an intercooler provided outside said casing;

wherein the discharge opening provided for one of said fixed scroll member is connected to said intercooler, and the suction opening provided for the other of said fixed scroll members is connected to said intercooler.

9. A scroll fluid machine according to claim 5, further comprising two thrust bearings provided on an inner peripheral side of said casing at rear sides of said two orbiting scroll members, respectively, to bear thrust loads acting on said orbiting scroll members, wherein said orbiting shaft has a length set so that the rear side of each of said orbiting scroll members and a front side of the thrust bearing associated with the orbiting scroll member are in contact with each other or have a slight gap therebetween.

10. A scroll fluid machine according to claim 9, wherein said rotating shaft has a larger wall thickness at a part thereof on a side opposite to a decentering side toward which said orbiting scroll member is decentered than at a part of said rotating shaft on said decentering side.

11. A scroll fluid machine according to claim 9, wherein each of said orbiting scroll members has a communicating bore formed in a center of the end plate, said communicating bore communicating with an inside of said orbiting shaft.

12. A scroll fluid machine according to claim 9, further comprising:

suction openings provided in said casing at respective positions facing outer peripheries of the wrap portions of said fixed scroll members;

discharge openings provided in said casing at respective positions facing centers of the wrap portions of said fixed scroll members; and an intercooler provided outside said casing;

wherein the discharge opening provided for one of said fixed scroll member is connected to said intercooler, and the suction opening provided for the other of said fixed scroll members is connected to said intercooler.

* * * * *